United States Patent [19]

Stiller et al.

[11] 4,272,356

[45] Jun. 9, 1981

[54] COAL EXTRACTION PROCESS

[76] Inventors: Alfred H. Stiller, 459 Lawnview Cir.; John T. Sears, 200 Jackson Ave., both of Morgantown, W. Va. 26505; Richard W. Hammack, 9837 Presidential Dr., Apr. 104, Allison Park, Pa. 15101

[21] Appl. No.: 137,829

[22] Filed: Apr. 7, 1980

[51] Int. Cl.[3] ..... C10G 1/00; C07C 37/68

[52] U.S. Cl. ..... 208/8 LE; 568/761

[58] Field of Search ..... 208/8 LE; 568/761

[56] References Cited

U.S. PATENT DOCUMENTS

| | | | |
|---|---|---|---|
| 2,049,013 | 7/1936 | Lowry, Jr. | 208/8 LE |
| 2,242,822 | 5/1941 | Fuchs | 252/426 X |
| 4,070,268 | 1/1978 | Davis et al. | 208/8 LE |
| 4,090,957 | 5/1978 | Leonard | 208/8 LE X |

FOREIGN PATENT DOCUMENTS

| | | | |
|---|---|---|---|
| 1287570 | 8/1972 | United Kingdom | 208/8 LE |

*Primary Examiner*—Delbert E. Gantz
*Assistant Examiner*—William G. Wright
*Attorney, Agent, or Firm*—Mason, Fenwick & Lawrence

[57] ABSTRACT

Sub-divided coal is extracted under non-thermally destructive conditions with a solvent liquid containing a compound having the general formula:

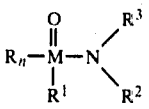

where

M is a carbon, sulfur, or phosphorus atom, $R^2$ and $R^3$ are each a hydrogen atom or a lower alkyl group, R and $R^1$ are each a lower alkyl group, another

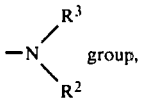

a monocyclic aromatic group, or $R^1$ can be another

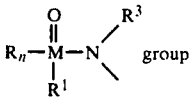

or $R^1$ and $R^2$ together can represent the atoms necessary to close a heterocyclic ring, and n=1 where M=phosphorus and is otherwise 0, to substantially remove the non-fixed carbon content of the coal, leaving a solid residue of the fixed coal carbon, ash and non-extractable matter.

9 Claims, 1 Drawing Figure

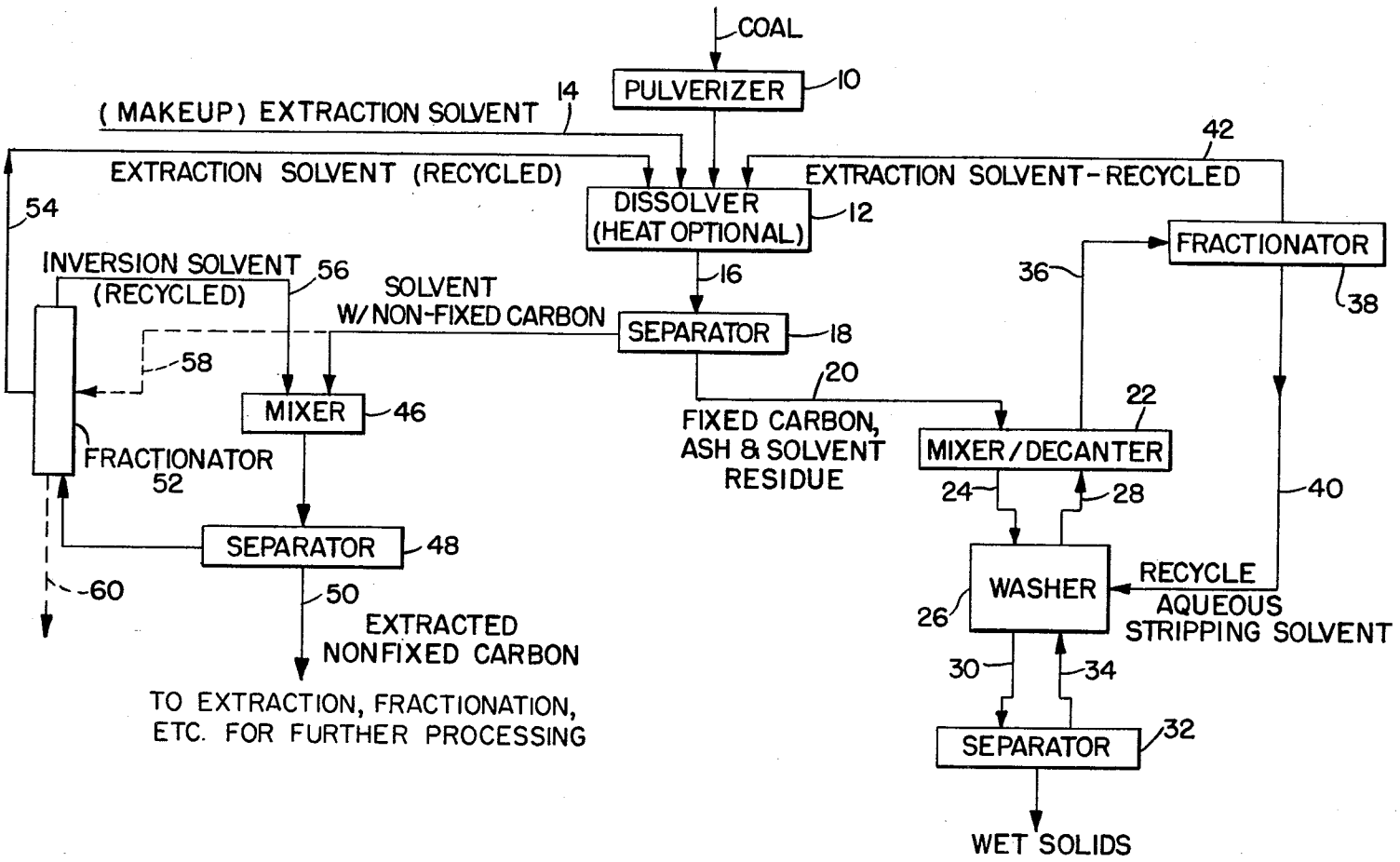
COAL
PULVERIZER
10
(MAKEUP) EXTRACTION SOLVENT
14
EXTRACTION SOLVENT (RECYCLED)
EXTRACTION SOLVENT-RECYCLED
42
DISSOLVER (HEAT OPTIONAL)
12
16
SEPARATOR
18
20
FIXED CARBON, ASH & SOLVENT RESIDUE
FRACTIONATOR
38
40
36
MIXER/DECANTER
22
24
28
WASHER
26
RECYCLE AQUEOUS STRIPPING SOLVENT
34
30
SEPARATOR
32
WET SOLIDS
SOLVENT W/NON-FIXED CARBON
INVERSION SOLVENT (RECYCLED)
56
58
MIXER
46
FRACTIONATOR
52
54
SEPARATOR
48
50
60
EXTRACTED NONFIXED CARBON
TO EXTRACTION, FRACTIONATION, ETC. FOR FURTHER PROCESSING

COAL EXTRACTION PROCESS

FIELD OF THE INVENTION

This invention relates to a process for extracting coal and is directed more exactly to an improved coal extraction process carried out under non-thermally destructive conditions to permit substantial recovery of the non-fixed carbon content of the coal.

BACKGROUND OF THE INVENTION

The mineral coal is a complex mineral of widely varying composition and structure, dependent upon the location and conditions under which it was formed in nature. In general, coal is classified or ranked according to its content of volatile matter which can range from around 50% or more for lignite or cannel coal to about 20-30% for a middle rank bituminous, gas or coking coal to 10% or less for a high ranking bituminous coal or anthracite, the remainder being constituted by nonvolatile or fixed carbon together with minor amounts up to about 8% or so of each of ash and moisture.

It has long been known to subject coal to pyrolytic destructive distillation to drive off the volatile content and leave the nonvolatile matter in a solid form known as coke having valuable properties as a fuel in the production of iron and steel and in the production of gases for heating and illumination. As originally practiced, the volatile matter was allowed to escape as waste into the atmosphere, but it was soon realized that the volatile matter was valuable in itself by virtue of the inclusion therein of a large number of organic chemicals having valuable utility in industry in themselves or as intermediates for the formation of technologically important derivatives. There are now known to be contained in coal tar extracted from coal nearly 300 different organic chemical compounds including benzene and its alkylated and partially or totally hydrogenated derivatives, styrene, naphthalene and anthracene and their derivatives together with numerous other carbocyclic and heterocyclic hydrocarbons, particularly those based on fused ring systems.

The temperature and other conditions of the pyrolytic decomposition or carbonization of the coal can vary considerably in order to tailor the output of the process to exaggerate the formation of certain particularly desirable compounds. Where the process conditions are selected as to be especially severe, it is usually referred to as a gasification process, the object of these conditions being to magnify the gaseous content of the reaction as greatly as possible. These vapor phase products can be condensed to produce oil fractions useful directly or by intermediate conversion, as by catalytic reforming and/or cracking as diesel oil and gasoline for internal combustion engines. Direct hydrocarbonization gasification processes subject the coal to hydrogen gas under high pressure in the order of about 50-100 atmospheres and are consequently expensive and difficult to practice, although such processes have become increasingly the object of concentrated research as an alternative source of IC engine fuel to natural petroleum.

In another type of coal gasification, the coal is heated in the presence of air, steam, oxygen or a combination thereof, to produce by reaction of the carbon in the coal, fuel gases of varying proportions of carbon monoxide, carbon dioxide, hydrogen and occasionally nitrogen for industrial and domestic heating, as a source of hydrogen or for further conversion. In modern processes of this type, the coal is introduced continuously into a moving or fluidized bed reaction zone with the gaseous products being taken off from the top of that zone and unreacted solid residue from its bottom. Because of the interference of substantial amounts of tar, the application of the process is hence limited.

It is also known to subject coal to so-called liquefication processes in which the coal is treated under less severe conditions than utilized for carbonization and gasification, usually at temperatures below about 600° C. at which substantial gas formation is initiated and under pressure. Even at this condition, coal is difficult to dissolve and heavy attention has been directed in research in this field to the identification of solvents capable of dissolving the coal and for the most part the solvents found to be more or less effective have been based on hydrogen-rich or protonic organic liquids, usually derived from the coal itself or as specialized by-products from the distillation and fractionation of petroleum, having a chemical structure adapted to compensate the natural hydrogen deficiency of coal which tends to impede its dissolution. Such processes are frequently carried out under high pressure in a hydrogen atmosphere to make available additional hydrogen atoms for combination with the coal. The following is a list of patents which relate to this kind of coal liquefication process:

2,572,061;
3,375,188;
3,379,638;
3,642,608;
3,705,092;
3,726,785;
3,849,287;
3,852,183;
3,867,275;
3,870,621;
3,956,436;
4,040,941;
4,052,291;
4,052,292;
4,189,373.

Even though a fraction of the reaction products from the liquefication process may be withdrawn and recycled for combination with fresh amounts of coal, these processes are fundamentally independent on the derivation of solvents directly from natural energy materials which might be better used for their usual purposes. In addition, in their modern versions, these processes can be carried out in the presence of finely divided solid catalysts serving to increase the efficiency of the reaction and/or bias the reaction toward the formation of particularly desirable end products, e.g., gasoline and diesel oil, and these catalysts inherently tend to become poisoned in time so as to lose their effectiveness.

Moreover, various recovery techniques are necessary for the separation and purification of the liquefication products, including packed columns and filters and as the liquefication products contain a high content of tar, wax and the like, the separation units are seriously susceptible to clogging which requires cleaning and replacement from time to time.

Finally, in the rare instances in the art where coal has been subjected to simple extraction, e.g. U.S. Pat. No. 2,242,822, preliminary oxidation of the coal has been indispensable to convert it into a form susceptible to dissolution in furfural and furane derivatives employed as solvents.

OBJECTS OF THE INVENTION

The ultimate object of the present invention is the provision of a process for the extraction of coal with a novel solvent which exerts solvent action on the coal under mild processing conditions at temperatures below the mesophase formation (softening) in coal.

A further feature of the inventive process is the availability of simple measures for separating the extraction solvent from both the dissolved and residual undissolved matter of the coal which permits recovery of the solvent for further use in the extraction of fresh coal.

A further feature of the invention is an extraction process which does not generate substantial amounts of vapor phase products and consequently does not require special equipment for handling these products.

A further feature of the inventive process is the separation of a solid residue of non-extractable matter, mainly mineral carbon, which is readily recoverable in activated form suitable for a variety of industrial uses.

BRIEF DESCRIPTION OF THE DRAWING

These and other objects and advantages will be apparent from the following detailed description when read in conjunction with the accompanying drawing which is a diagramatic flow sheet of one embodiment of process embodying the present invention.

DETAILED DESCRIPTION OF THE INVENTION

All known types of coal are, in principle, suitable for treatment in accordance with the present invention; although as will be understood, the selection of a particular type of coal to be treated will directly influence the nature of the ultimate end products, and different types of starting coal will necessarily result in a different make-up of end products. In the classical analysis of coal, it, as already mentioned, is ranked generally according to the content of volatile matter which is released during pyrolytic decomposition or, contrariwise, the content of nonvolatile carbon content which principally constitutes the residue after pyrolytic decomposition. Obviously, the conditions of pyrolytic decomposition even at the mild end of the spectrum must cause side reactions in which nominally nonvolatile matter is decomposed or cracked into lesser components which either directly or after recombination with other components go into the gaseous state while nominally volatile matter may either directly or after similar decomposition or cracking undergo combination, e.g. polymerization or the like, or reaction with parts of the nominally solid matter or decomposition products thereof to produce nonvolatile end products. Thus, the volatile and nonvolatile carbon content according to classical analysis cannot in general be presumed to correspond to the actual starting proportions of these materials in the natural coal since the end quantities thereof are not independent of the reaction but are in significant measure a function of reaction conditions, including time as well as temperature and pressure.

In the present invention, the extraction process is carried out under non-thermally destructive conditions in the context of which the classical terminology is inappropriate and needs to be replaced by the terminology fixed carbon and non-fixed or mobile carbon, respectively. The significance of these terms is more fully understood if the coal is visualized as a framework or matrix of carbon black, structure as a non-crystalline collection of graphite-like plates, onto which is adsorbed a coating of tar-like material. The surface tars fall into two general categories; namely, bitumens including all compounds susceptible to extraction by classical organic solvents and kerogen including the compounds which resist classical solvent extraction. According to the present invention, essentially all of the bitumen is extracted together with a significant amount or even the bulk of the kerogen without the necessity for thermal destruction of the coal.

The aforegoing discussion helps to explain the scope of application of the process of the invention. To the extent that the natural coal to be treated contains non-fixed carbon (and all natural coals have at least a minor content of this matter), then the present process is useful in conjunction with that type of coal for the purposes of removing from that coal at least a substantial portion of whatever non-fixed carbon content it naturally contains. Furthermore, the fixed carbon content of the particular coal is also improved by the present process which in removing the tars from the pores of the fixed carbon matrix renders the same more responsive to whatever end utility the particular residual solids might be intended.

The coal is sub-divided for purposes of the present extraction treatment but the size of the coal particles thus sub-divided is not critical. As with any contact process, the rate of the extraction tends to increase as the surface area of the material being extracted increases and, consequently, advantage can be taken of this common principle by sub-dividing the coal to fairly fine size. Particles passing through a 200 mesh screen have been found to be a convenient size from a practical standpoint. Particles within the range between about 12 and 250 mesh should be effective for present purposes but, as previously indicated, the particle size is not critical and particles larger or smaller than this range might well prove useful.

The essential solvent component of the solvent medium used in the extraction process of the present invention is a liquid compound or mixture of liquid compounds within the following general formula:

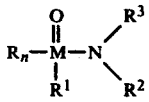

where

M is a carbon, sulfur, or phosphorus atom, $R^2$ and $R^3$ are each a hydrogen atom or a lower alkyl group, R and $R^1$ are each a lower alkyl group, another

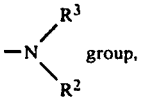

group, a monocyclic aromatic group, or $R^1$ can be another

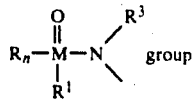

or $R^1$ and $R^2$ together can represent the atoms necessary to close a heterocyclic ring, and n=1 where M=phosphorus and is otherwise 0.

Where $R_n$ and $R^1$ are either or both lower alkyl groups in this formula, alkyl can apparently have a carbon content in the range of $C_1$-$C_4$ or possibly $C_5$, of which $C_1$ and $C_2$ are considered preferable. Preferred substituents for $R^2$ and $R^3$ are methyl and ethyl groups, although it is presumed that homologs up to about $C_4$ or possibly higher would produce more or less useful solvent compounds, and the replacement of such groups with one or more hydrogen atoms also appears to be an acceptable alternative. Monocyclic aromatic groups such as a benzyl radical might also prove useful as the substituent R or $R^1$, because the structure of this group is favorable to the resonance stabilizing function of the solvent. Either or both of $R_n$ and $R^1$ can be another amino group

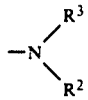

In selecting the combination of specific groups for the substituents R, $R^1$, $R^2$ and $R^3$, one should avoid the inclusion in the solvent compound molecule of so large a number of carbon atoms, considered collectively for all of the substituent groups, as would impair the requisite solvent properties, but subject to this overriding criterion, a considerable variety of substituent groups are conceivable and, as between $R^2$ and $R^3$, the substituent groups need not be the same. Specific preferred solvent compounds within the above formula include tetramethyl urea (TMU) of the formula $(CH_3)N—CO—N(CH_3)_2$, N-,N-dimethyl acetamide (DMAA) of the formula $CH_3—CO—N(CH_3)_2$, hexamethyl phosphoramide (HMPA) of the formula $(CH_3)_2N—PO[-N(CH_3)_2]_2$ and (less preferred) tetramethyl amide sulfoxide of the formula $(CH_3)_2N—SO—N(CH_3)_2$. Where $R^2$ and $R^3$ together form the atoms closing a heterocyclic nucleus, compounds such as N-methyl pyrrolidine and its analogs, etc., which are liquid at the process temperature, as possible. The solvents of the invention can under appropriate circumstances form dimers, etc., for example $(CH_3)_2—N—CO—N(CH_3)—CO—N(CH_3)_2$, and these when liquid can be effective. It is not fully understood why the processes of this present invention accomplish results so strikingly different from the prior art of extraction utilizing high pressure and high temperatures (above 350° C.). However, although it is not intended that the present invention be bound by this explanation, it is believed that the above defined class of solvents extracts the non-fixed carbon by acting as a solvent for polymeric material in the coal and also stabilizing electrons and free radicals that are present in the coal, and as a result, the coal is dissolved.

As with the particle size range of the coal, the amount of solvent employed in the present process is not critical, but is primarily governed by practical and economic factors. Indeed, because of the random distribution and combination of organic groups in natural coal, which groups ultimately determine the amount of solvent required for their dissolution, it is virtually impossible to establish in advance any precisely exact amount of solvent needed for essentially complete extraction. Countercurrent extraction or multiple extractions can be envisioned as the present process can occur at low temperatures and at atmospheric pressure. In general, an excess of the solvent is desirable in order to maximize the extraction efficiency, especially bearing in mind the variability in solubility of some of the tar constituents in the solvents of the class in question, which may vary from as small as $10^{-3}$gm/l to a complete dissolution. Roughly speaking, a useful ratio range of solvent to coal is about 1-10:1 by volume, although these limits are, as stated, not critical. At a minimum, the amount of solvent should be sufficient to suspend the coal particles for free and easy agitation.

An important advantage of the present extraction is the avoidance of harsh reaction conditions that would lead to side reactions and/or destructive decomposition of the coal and any of its derivative products. The selection of a particular temperature for carrying out the present extraction process is influenced by several parameters. First, the temperature must be below that at which any destructive interaction takes place between the extraction solvent and the fixed carbon content of the coal. The limitation is particularly significant with respect to HMPA which has been observed to undergo chemical interaction at about 100° C. with the formation of a gummy tar which makes solvent recovery difficult, if not impossible. Other solvents within the novel class of the invention so far appear to be much less subject to the restriction and as to these a further parameter applies; namely, that the temperature should not exceed the boiling point of the solvent at the selected operating pressure. Finally, the extraction temperature should be below that at which terminal degradation or decomposition of the coal begins which is generally considered to occur around 400° C. or above and below the mesophase or softening point of the coal. The extraction can be carried out at room temperature but mild heating may be preferred in order to increase the kinetics of the extraction mechanism. The application of pressure is not necessary in the present process which offers the practical advantage of allowing the process to be carried out in an open and less expensive system. Modest pressure may tend to increase process efficiency due to the simple mechanical effect of pressure in forcing the solvent into the fixed carbon matrix of the coal, but the application of high pressures (for example, with hydrogen gas) as is characteristic of prior art processes in order to initiate chamical reaction of the coal is not needed in the practice of the invention and should be avoided.

As the extraction proceeds, the solvent normally acquires an intense dark coloration from the tar solute but the absence of this coloration alone does not necessarily indicate the failure to achieve any extraction of the coal since some of the products obtained in the practice of the invention have been recovered as white crystals. Consequently, the solvolysis phase of the present process can be generally taken as complete when the addition to the coal of fresh solvent at the highest suitable operating temperature brings about no change in the spectral characteristics of the solvent, especially its infrared and ultraviolet light absorptivity, as detected by instrumentation capable of measuring these spectral characteristics.

While this invention is essentially predicated upon the use of a solvent compound of the general formula noted above, no reason is known why that solvent could not, in principle, be combined with other conventional solvents or diluents which at least do not impair the unique solvent activity of such solvent compound.

Depending upon the selected starting coal, the content of extracted tar will vary for one extraction from about 10 to about 50–60% by weight of the coal itself, and the concentration of the tar solute will naturally depend upon the ratio of solvent to coal employed in the particular embodiment. The mixture of solute and solvent can be separated from the solid residue of the coal by conventional separation equipment, such as a filter or centrifuge. The liquid phase is then processed to separate the solvent medium to permit its recovery and recycling with attendant cost advantages. Recovery of solvent can be accomplished by vacuum distillation or evaporation. An effective technique for this purpose is a so-called mixed solvent precipitation. In this technique, a solubility inverting solvent having a signicantly lesser solvent capacity for the dissolved non-fixed carbon content than the novel solvents of the invention is admixed to the liquid phase in sufficient quantities as to bring about salting out or precipitation of the non-fixed carbon content. The precipitated material can then be separated from the mixed liquid phase by decantation, filtration, or centrifugation and the components of the mixed liquid medium separated from one another by distillation or other conventional fractionation procedures which can have a relatively low energy consumption. The selection of a solubility inverting solvent for this step of the process should pose no problem since a wide variety of solvents have been found useful for this purpose. The preferred solvents include the common lower alcohols such as methanol, diethyl ether or the like, but, rather surprisingly, aromatic solvents, such as toluene and benzene have also been found to work. Normally non-polar organic solvents, particularly of the aromatic type, would be expected to be miscible with the dissolved coal tar solute and their failure to do so cannot be fully rationalized. Possibly, this result can be explained by a preferential miscibility of these aromatic solvents for the extraction solvents of the invention to the exclusion of the tar solute or conceivably a solvent dilution effect is taking place, but whatever the explanation, it presently appears that virtually any solvent having good miscibility with the extraction solvent will qualify as an inversion solvent in this step. Water itself is useful in principle, although it, as will be explained subsequently, tends to lead to the creation of a colloidal suspension of the solute making in some instances the ultimate separation of the phases more difficult since the colloid is more resistant to settling out or sedimentation than otherwise.

The separated precipitate which has a thick consistency, represents the non-fixed carbon content of the coal; it is somewhat equivalent to the tar products obtained in prior art carbonization and/or gasification processes and is generally adapted for the same end purposes served by these conventional end products but with the peculiar advantage that valuable chemicals and chemical intermediates contained in the original coal have been extracted in significant amounts. They are, therefore, available for direct recovery or, alternatively, for further chemical processing which can consequently be more positively controlled and directed to produce selected end products than is possible in the random environment of prior art procedures. For example, the separated non-fixed carbon precipitate can be treated with solvents having a preferential dissolving action for selected constituents therein, as already in use in the art, and any remaining unextracted matter can then be used in conventional ways for carbonaceous materials.

As regards the solid material from the extraction, this material necessarily contains a certain small residue of solvent therein which desirably is removed and recovered. As separated from the liquid phase, the solid particle residue, with residual solvent, has a rather thick consistency more or less comparable to that of honey and can be suspended by mixing with an aqueous medium, e.g. water or mixtures of water and alcohol, etc., to form a colloidal suspension. The aqueous medium acts as a stripping solvent for the treatment solvent, having a higher attraction therefor than for the solid particles so that the residual solvent is tripped from its state of adsorption on the particle surface and is presumably being replaced by water. The aqueous medium can also interact with the fixed carbon solid by serving as a proton donor to the now activated fixed carbon matrix and further break down the fixed carbon matrix. The solid particles can be separated from the liquid mixture by a filter, centrifuge or other conventional separation equipment, and the solvent and water mixture can in turn be separated into its component liquids by distillation or other conventional fractionation means which permits the separated liquids to be recycled to minimize liquid consumption in the present process.

The wet particles containing mainly fixed carbon and ash recovered in this process are in a form which is especially advantageous for further utilization, e.g. as combustible fuel comparable to coke, or in the production of synthetic fuels. Because the solid fixed carbon particles are free of significant amounts of tar, they tend to react with improved efficiency in these processes without any of the practical difficulties which accompany the presence of tar. Moreover, the stripping of the residual solvent from the particle surface results in activation of these particles with corresponding increase in their reactivity.

The original ash content of the coal which is contained within the recovered solid particles is the source of most of the sulfur contamination of the original coal. If these particles are to serve as a solid fuel, separation of the ash may then be desirable so as to reduce the tendency of the final solid particles to cause atmospheric pollution when combusted. This separation may be accomplished when the solid residue is emulsified in the aqueous media. If the particle size of the fixed carbon is reduced by this processing to the particle size of the mineral matter, the fixed carbon remains dispersed while the mineral matter sinks and can be separated by conventional means, such as centrifuging.

It will be apparent that the particle solids recovered from an initial extraction stage can be again subjected to extraction one or more times and, indeed, it appears that additional amounts of the coal solids respond to the repeated solvolysis action, although, of course, at decreasing quantitative rates and it is at least conceivable that substantially all of the carbon content of the coal can be ultimately extracted, save only for the ash, in this manner.

DESCRIPTION OF EXEMPLARY WORKING SYSTEM

A flow sheet for a typical working system for carrying out the extraction process of the present invention is shown in diagrammatic fashion in the accompanying drawing. In this system, lump coal or the like from any selected source is delivered to a pulverizer or mill 10 which reduces the coal to the desired particle size and if separation of the fines and oversize material is advisable, this may be accomplished by means of any conventional screening system nor shown in the drawing. The sub-divided coal of the desired particle size or size range is then introduced into a dissolver 12 for admixture with the novel solvent medium according to the invention in selected proportions. Ideally, the great bulk of the extraction solvent is recycled from subsequent processing steps, but any additional solvent needed to make up for unavoidable loss of solvent during processing can be added through a make-up line 14. In dissolver 12, the solvent and pulverized coal are agitated under the selected conditions of temperature and pressure within the general limits described above for a period of time necessary to extract a substantial amount of the non-fixed carbon content from the coal. The outlet 16 of dissolver 12 delivers the suspension of extracted coal particles in the solvent solution of the extracted non-fixed carbon matter to a separator 18, such as a filter or centrifuge capable of effecting separation of the liquid phase from the solid phase. The solid phase consisting of the fixed carbon content of the coal together with the ash, which contains non-carbon mineral compounds, such as iron sulfide, etc., leaves the separator 18 through line 20 for conveyance to a mixture/decanter 22 where it is admixed with an excess of an aqueous medium, which can be water, to form a colloidal suspension of the solid particles in the mixture of water and residual solvent stripped off from the particles, and this colloidal suspension is passed via line 24 to washer 26 to dilute the extraction solvent concentration in the liquid in contact with the solids by the addition of more stripping solvent preferably recovered from the mixer/decanter. The overflow liquid 28 is returned to the mixer/decanter 22. The bottom solids are delivered via line 30 to separator 32, e.g. a filter or centrifuge, where excess aqueous solution is removed from the solid particle phase and returned by line 34 to the washer 26. As the densities of the fixed carbon content and mineral matter are different, the two solids may be separated by conventional techniques if desired. The solid particles which are somewhat analogous to activated carbons, are then ready for use for any purpose to which the activated carbons and related materials are known to be adapted. The excess liquid from the initial aqueous medium mixer/decanter 22 is decanted and delivered by line 36 to a distillation column 38. The fractionator 38 separates the aqueous medium from the extraction solvent, and the aqueous medium is recycled to the washer 26 by line 40. The extraction solvent is recycled by line 42 to the dissolver 12.

The effluent from separator 18 formed of the solution of non-fixed carbon in the extraction solvent passes by a line 44 to mixer 46 for admixture therewith of an alcohol or like inversion solvent liquid which is miscible with the treatment solvent liquid but of significantly lower solent capacity for the dissolved non-fixed carbon matter so that the dissolved non-fixed carbon content is longer held in solution in the mixture but is salted or precipitated out as a thick, dark liquid. This thich phase can be separated in separator 48 (or decanted in mixer 46 if preferred) and collected by line 50 for further processing such as extraction and/or fractionation and the like.

The lighter liquid phase is taken from the separator 48 to a fractionator, e.g. a distillation column or evaporator 52 for separation of the extraction solvent and the inversion solvent to permit these to be recycled by line 54 to the initial dissolving stage 12 and by line 56 to the inversion mixing stage 46.

Alternatively, the solute phase from separator 18 containing the non-fixed carbon can be delivered directly to fractionator 52 as indicated by dotted line 58 and the extracted non-fixed carbon is taken from the bottom of the fractionator 52 as indicated by dotted line 60. At lower temperatures, the more volatile solvent is boiled off, leaving the non-fixed carbon in solid form. The extraction solvent is recycled as before.

EXAMPLES

1. Bakerstown coal (medium-volatile bituminous) is crushed to about 250 mesh. Fifty (50) ml of 50:50 mixture of tetramethyl urea (TMU) and hexamethylphosphoramide (HMPA) is mixed with 4.013 gm of the coal in a stirred, round-bottom reaction vessel at ambient temperature and open to the atmosphere. After treatment for fifteen (15) minutes, the mixture is filtered by suction through a medium-grade porous filter for perhaps fifteen (15) minutes. The filtered wet solids appeared by visual inspection to have about two-thirds ($\frac{2}{3}$) the original volume. The filtrate was stored in a flask. An additional fifty (50) ml of 50:50 TMU:HMPA was contacted with the solids in the reaction flask for thirty (30) minutes and again filtered as before. The filtrate was added to the previous filtrate in the storage flask. The solids were rinsed with TMU and the rinse liquid was also added to the storage flask. The residue was now washed with water to form in the flask a colloidal suspension, from which the mineral matter dropped to the flask bottom. The suspension was filtered through a fine filter, collected and washed with methanol to aid in drying the solids. Tests were run on the dried solid and water:

| | |
|---|---|
| Weight: | 1.73 gms |
| Surface Area: | 100 $m^2$/gm, approx. |
| Color on exposure to air: | chocolate brown |
| Water pH: | 3.5 |

The solvent non-fixed carbon solution was refluxed in a condenser to recover the solvent. The residue crystallized.

2. A sequence of ranked coals was extracted with solvents of the genral structure set forth above for comparison to benzene-chloroform mixture—a standard extraction for coal—to determine solvent efficiency:

| | |
|---|---|
| Coals used: | |
| High volatile, bituminous | Sewickley |
| Medium to low volatile, bituminous | Bakerstown and Freeport |
| Anthracite | Mammoth |
| Solvents used: | |
| Hexamethylphosphoramide | (HMPA) |
| Tetramethyl urea | (TMU) |
| Dimethyl acid amide | ($DMA^2$) |

-continued

| | |
|---|---|
| Benzene-chloroform | (B-C) |

In this experiment, 2.0 gm samples were put into a coarse-frit soxlet thimble which is connected to a 250 cc round-bottom flask containing 100 ml of solvent. The thimble is put in a soxlet extractor. The round-bottom flask equipped with magnetic stirrir is heated with a mantle to the solvent boiling point in the manner of soxlet extraction. The extractions are permitted to continue for 26 hours. The residues are washed with water and dried in a vacuum dessicator until constant weight is obtained. The weight of the original sample is divided into the weight of the sample after extraction to give percent solubility.

In the time allotted, extraction was not completed with HMPA or TMU because the extraction liquid retained some color while the extraction liquis for DMA[2] and B-C were colorless. The extracted weights may also have some error as the residues gain weight rapidly by moisture absorption on exposure to air. The results in the Table below demonstrate the relative effectiveness of the solvents with respect to each other and the various coals being extracted.

TABLE 1

| Solvent | Sewickley 2.0 | Freeport 2.0 | Bakerstown 2.0 | Anthracite 2.0 | Coals Used Initial weight grams |
|---|---|---|---|---|---|
| HMPA | .80 g | .90 g | .76 g | 1.8 g | Final weight solids after extraction |
| | 60% | 55% | 62% | 10% | Percent extracted |
| TMU | 1.18 g | 1.20 g | 1.23 g | 1.88 g | Final weight solids after extraction |
| | 42% | 40% | 39% | 6% | Percent extracted |
| DMA[2] | 1.58 g | 1.70 g | 1.65 g | 1.86 g | Final weight solids after extraction |
| | 21% | 15% | 16% | 7% | Percent extracted |
| Benzene | 1.85 g | 1.88 g | 1.76 g | 1.92 g | Final weight solids after extraction |
| Chloroform | 7% | 6% | 8.5% | 2% | Percent extracted |

What is claimed is:

1. A process of substantially extracting the non-fixed carbon content of coal containing fixed carbon and non-fixed carbon therein which comprises the steps of agitating said coal in sub-divided form in a solvent liquid comprising a liquid compound of the general formula:

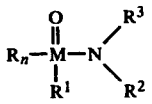

where

M is a carbon, sulfur, or phosphorus atom, $R^2$ and $R^3$ are each a hydrogen atom or a lower alkyl group, R and $R^1$ are each a lower alkyl group, another

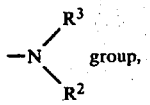

group, a monocyclic aromatic group, or $R^1$ can be another

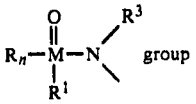

group or $R^1$ and $R^2$ together can represent the atoms necessary to close a heterocyclic ring, and n=1 where M=phosphorus and is otherwise 0, at a temperature below the softening temperature of coal until a substantial amount of the non-fixed carbon content of said coal is dissolved in said solvent, and separating the undissolved solid matter of said coal including fixed carbon from said solvent liquid containing non-fixed carbon dissolved therein.

2. The process of claim 1 wherein said coal and solvent liquid are agitated under generally atmospheric pressure.

3. The process of claim 1 wherein said coal and solvent liquid are agitated at a temperature in the range of about 20°-300° C.

4. The process of claim 1 wherein said coal has a particle size in the range of about 250-10 mesh.

5. The process of claim 1 wherein said solvent is present in a ratio by volume of said coal of about 1-10:1.

6. The process of claim 1 including the steps of separating the dissolved non-fixed carbon from said extraction solvent liquid and recycling said separated extraction solvent liquid for further agitation with fresh coal.

7. The process of claim 6 wherein said extraction solvent liquid is separated by admixing a solubility inversion solvent to the solution of non-fixed carbon in said extraction solvent in sufficient amount to precipitate said non-fixed carbon solute from said solvent mixture, separating said extraction solvent from said solvent mixture by fractionation, and recycling the thus-separated extraction solvent.

8. The process of claim 6 wherein said extraction solvent liquid is separated by evaporation, leaving a non-fixed carbon residue and recycling the extraction solvent liquid.

9. The process of claim 1 including the steps of suspending the thus-separated undissolved solid coal matter in a solvent-stripping liquid medium to separate said solid matter from said solvent-medium mixture and subjecting said solvent-medium mixture to fractionation for separating said medium and solvent from one another for recycling.

* * * * *